United States Patent [19]

Chu et al.

[11] Patent Number: 4,619,118

[45] Date of Patent: Oct. 28, 1986

[54] REVERSIBLE COMPRESSOR

[75] Inventors: Tsuwei Chu, Liverpool; Prakash N. Pandeya, Clay, both of N.Y.

[73] Assignee: Carrier Corporation, Syracuse, N.Y.

[21] Appl. No.: 668,541

[22] Filed: Nov. 5, 1984

[51] Int. Cl.[4] ..... F25B 13/00

[52] U.S. Cl. ..... 62/324.1; 62/324.6; 62/508; 137/625.43

[58] Field of Search ..... 62/324.1, 324.6, 160, 62/508; 137/625.43

[56] References Cited

U.S. PATENT DOCUMENTS 3,158,006 11/1964 Skeats et al. ..... 62/324.6
4,112,974 9/1978 Davis et al. ..... 62/324.6 X
4,178,768 12/1979 Pauliukonis ..... 62/324.6 X
4,306,422 12/1981 Korycki ..... 62/324.6
4,367,638 1/1983 Gray ..... 62/508

*Primary Examiner*—Lloyd L. King
*Attorney, Agent, or Firm*—David J. Zobkiw

[57] ABSTRACT

A spool valve is located within the shell of a hermetic compressor unit and shifted by a solenoid valve to direct the discharge of the compressor through either of two lines through the shell. Depending upon the line used as the discharge line, the compressor is suitable for either heating or cooling and is the equivalent of a reversible compressor. Alternatively, a spool valve can connect the suction line of a compressor to either of two lines extending through the compressor shell.

10 Claims, 6 Drawing Figures

REVERSIBLE COMPRESSOR

BACKGROUND OF THE INVENTION

In heat pump applications, the switchover from the heating to the cooling mode, and vice versa, reverses the flow direction of the refrigerant such that the coils serving as the condenser and evaporator, respectively, reverse functions. The flow reversal is generally achieved through a valving arrangement located externally of the compressor. For some types of compressors it is possible to selectively run them in either direction to achieve reversed flow.

SUMMARY OF THE INVENTION

In a hermetic compressor of conventional design, a spool valve is located within the shell for selectively directing the compressor discharge through either one of the two fluid lines extending through the shell. Concurrently, the other of the two fluid lines is connected with the interior of the shell which constitutes a suction plenum. The spool valve is shifted against a spring bias when one end of the spool is subjected to compressor discharge pressure under the control of a solenoid valve. Thus, the reversing of the flow paths takes place within the shell of the compressor rather than requiring a 4-way valve external of the compressor with the attending complications, such as complicated piping arrangements which make the system bulky and expensive. With modifications the present invention can also be used in a high-side compressor.

It is an object of this invention to provide apparatus by which presently manufactured compressors can deliver reverse flow without reversing the motor.

It is another object of this invention to convert compressors into reversible compressors for heat pump applications.

It is a further object of this invention to provide a compressor reversing mechanism which can be used in either a low-side or a high-side compressor, with modification. These objects, and others as will become apparent hereinafter, are accomplished by the present invention.

Basically, a spool valve is shifted between two positions under the control of a solenoid valve. The spool valve is located within the compressor shell and in a first position provides a fluid path between the compressor discharge and a first line extending through the shell and permits fluid communication between a second line extending through the shell and the interior of the shell. In the second position, the spool valve provides a fluid path between the compressor discharge and the second line extending through the shell and permits fluid communication between the first line and the interior of the shell. In a second embodiment, the spool valve provides communication between one of the two lines extending through the shell and the compressor suction line and permits communication between the other one of the two lines and the interior of the shell which defines the discharge plenum.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
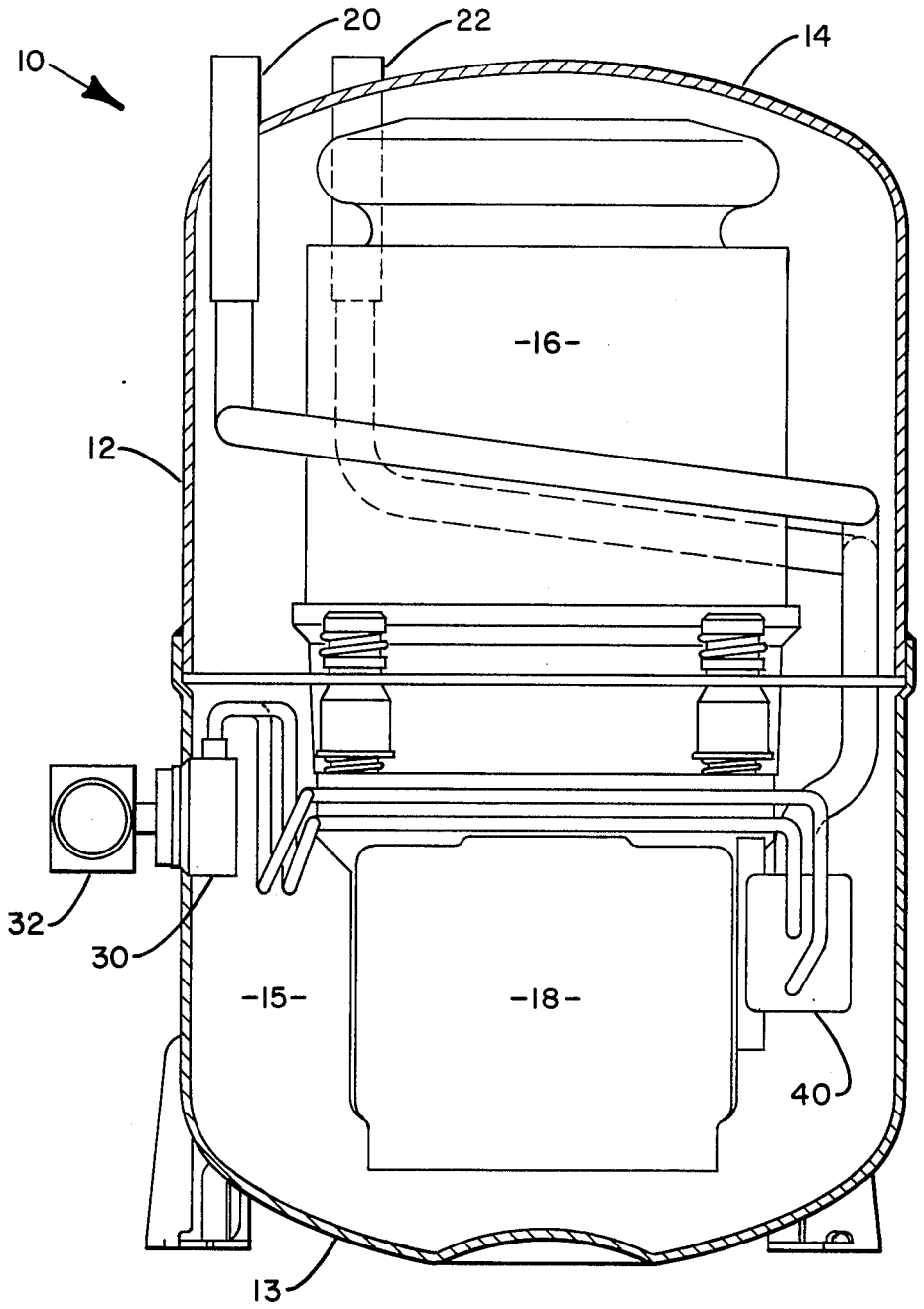
FIG. 1 is a vertical view through the shell of a hermetic compressor unit employing the present invention.
Figure 2:
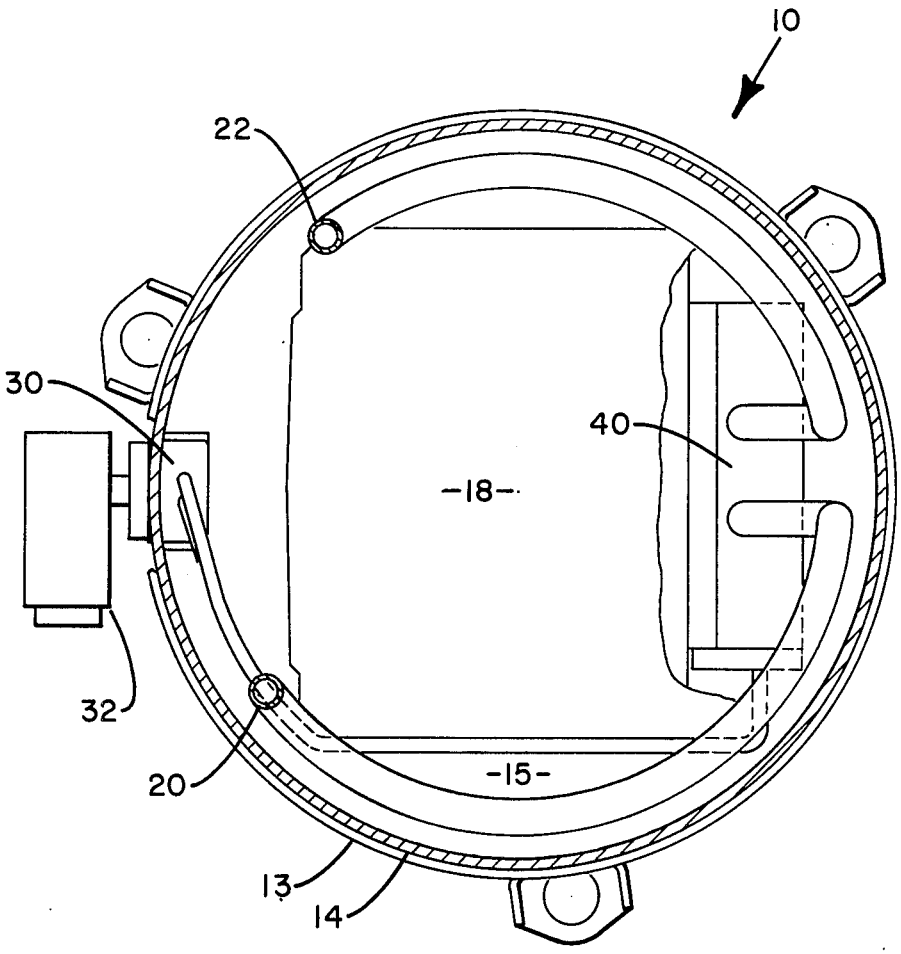
FIG. 2 is a partially cut away top view through the shell of a hermetic compressor unit with the motor removed.
Figure 3:
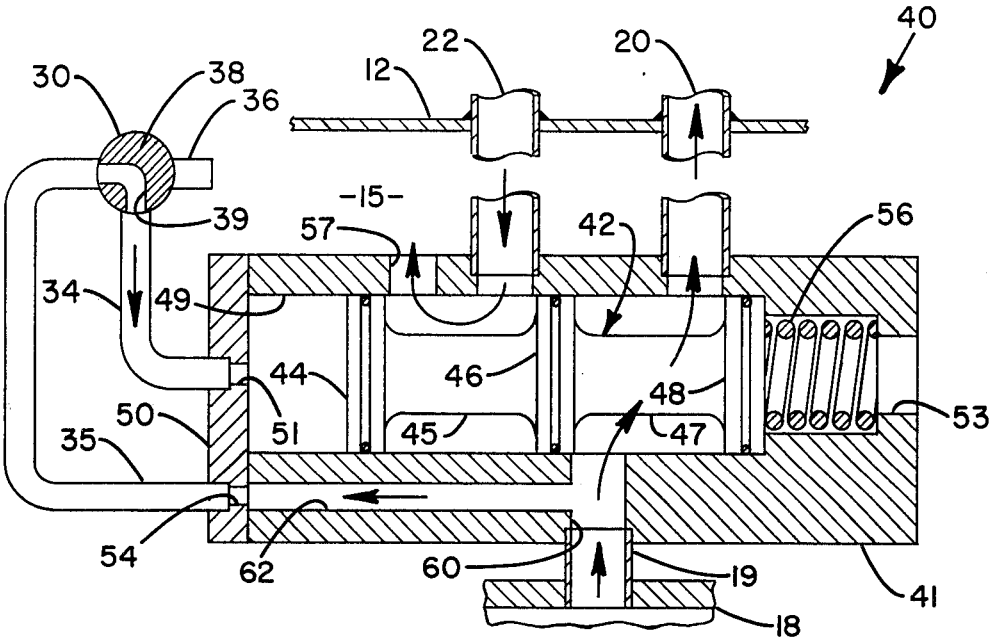
FIG. 3 is a sectional view showing a first position of the spool valve in a low-side compressor.
Figure 4:
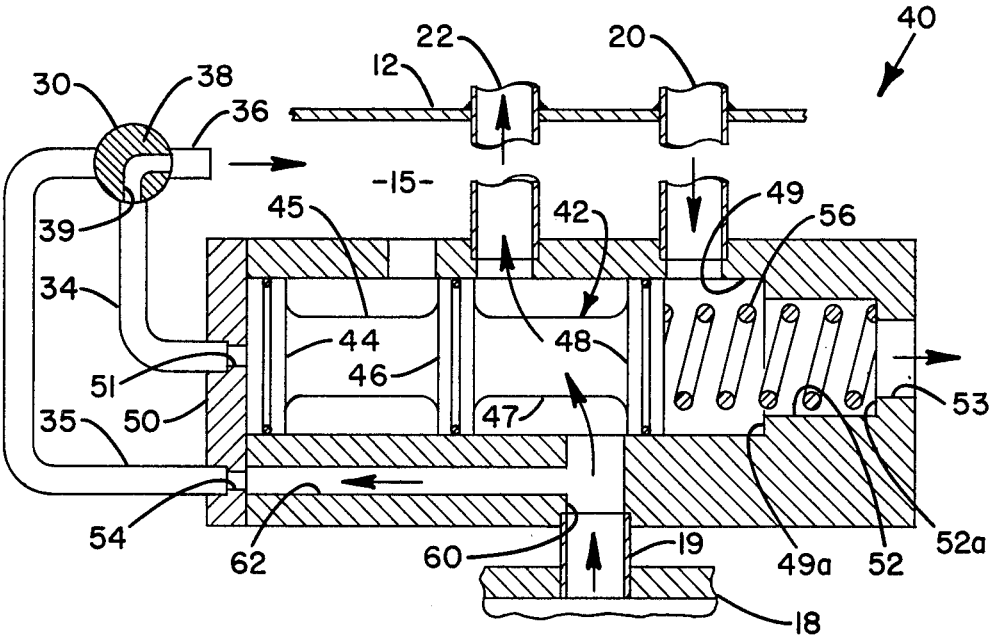
FIG. 4 is a sectional view showing a second position of the spool valve in a low-side compressor.

Referring to FIGS. 1 and 2, the numeral 10 generally designates a low-side hermetic compressor unit having a shell 12 made up of lower portion 13 and upper portion 14. Within shell 12 are single direction motor 16 and reciprocating compressor 18. Two lines, 20 and 22, extend through shell 12. Lines 20 and 22 are connected through a fluid path containing at least two heat exchange coils (not illustrated) which can act as either a condenser or as an evaporator depending upon the flow direction. The structure described so far is conventional and functions in a conventional fashion such that motor 16 always turns in the same direction and compressor 18 also always runs in the same direction. Additionally, located within the suction chamber 15 defined by shell 12 are solenoid valve 30, which is actuated by externally located solenoid 32, and spool valve 40. Control and powering of solenoid valve 30 can be by the structure used in conventional heat pump systems wherein a thermostat or other temperature responsive device causes actuation of the compressor and the positioning of the conventional 4-way valve responsive to sensed temperature. Referring now to FIGS. 3 and 4, it is readily apparent that spool valve 40 is connected to discharge line 19 of compressor 18 and provides a fluid path between line 19 and either line 20 or 22. Specifically, spool valve 40 includes valve housing 41 and spool 42 having lands 44, 46 and 48 and grooves 45 and 47. As spool 42 reversibly shifts its position in bore 49 from the FIG. 3 to the FIG. 4 position, the flow path provided by groove 47 moves from a position connecting lines 19 and 20 to a position connecting lines 19 and 22.

One end of bore 49 is connected to line 34 via bore 51 in end piece 50 and the other end of bore 49 contains reduced bore portions 52 and 53 connecting bore 49 to suction chamber 15 and defining steps **49*a* and 52*a*. Spring 56 is located in bore 49 and reduced bore portion 52 with one end of spring 56 seating against step 52*a* and the other end of spring 56 seating against spool 42 and tends to bias spool 42 to the FIG. 4 position. Discharge line 19 is connected to bore 49 via passage 60 and bore 62 connects passage 60 to line 35 via bore 54 in end piece 50. Lines 34, 35 and 36 are each connected to solenoid valve 30 which contains a movable valve member 38 having passage 39 therein. Valve member 38 is movable responsive to the actuation and de-actuation of solenoid 32 between the FIG. 3 and FIG. 4 positions to connect line 34 to lines 35 and 36**, respectively.

In operation, assuming that FIG. 3 represents the position of valve member 38 of solenoid valve 30 when solenoid 32 is not actuated, motor 16 drives compressor 18 such that gaseous refrigerant is drawn into the compressor 18 from the suction chamber 15 which is defined by shell 12. Compressor 18 compresses the refrigerant and the compressed refrigerant is discharged from compressor 18 via discharge line 19 to passage 60 of spool valve housing 41. With solenoid valve 30 in the FIG. 3 position, refrigerant at compressor discharge pressure is able to serially pass from passage 60 to bore 62 in spool valve housing 41, bore 54 in end piece 50, line 35, passage 39 in movable valve member 38, line 34 and bore 51 in end piece 50 to bore 49 where the pressure acts on the end of spool 42 at which land 44 is located. The compressor discharge pressure acting on the one end of spool 42 is opposed by the biasing force of spring 56 and the pressure of the refrigerant in the suction chamber 15 which results in spool 42 shifting to the position illustrated in FIG. 3. With spool 42 in the FIG. 3 position, compressed refrigerant supplied to passage 60 passes into bore 49 in the annular space defined by groove 47 and lands 46 and 48, then passes into line 20 and exits shell 12. The refrigerant exiting shell 12 via line 20 flows to a first coil (not illustrated) which acts as a condenser to liquify the refrigerant by removing heat therefrom. The liquid refrigerant then passes through an expansion means (not illustrated) into a second coil (not illustrated) which acts as an evaporator and when the liquid refrigerant becomes a gas and in this process absorbs heat from the ambient surroundings to be cooled. The gaseous refrigerant then passes via line 22 into bore 49 in the annular space defined by groove 45 and lands 44 and 46 and via bore 57 into suction chamber 15 from which it is drawn by compressor 18 and the continuous cycle repeated.

If solenoid 32 is actuated, valve 38 is rotated to the FIG. 4 position whereby fluid communication between line 35 and bore 49 is cut off and the bore 49 at the end of spool 42 at which land 44 is located is in fluid communication with suction chamber 15 serially via bore 51, line 34, passage 39 and line 36. The other end of spool 42 at which land 48 is located is also in communication with suction chamber 15 via reduced bores 52 and 53 and, depending upon the spool position, via line 20. With suction chamber pressure acting on each end of the spool 42 and, therefore, being in balance, the bias of compression spring 56 shifts spool 42 to the position of FIG. 4. In this position of spool 42, refrigerant supplied to passage 60 passes into bore 49 in the annular space defined by groove 47 and lands 46 and 48 then passes into line 22 and exits shell 12. The refrigerant exits shell 12 via line 22, flows to the second coil (not illustrated) which now acts as a condenser, then passes through the expansion means (not illustrated) and into the first coil (not illustrated) which now acts as an evaporator. The gaseous refrigerant then passes via line 20 into the bore 49, through the reduced bores 52 and 53 into suction chamber 15 from which it is drawn by compressor 18 and the continuous cycle repeated. If solenoid 32 is de-actuated, it will return valve member 38 to the FIG. 3 position.

From the foregoing, it should be clear that starting with the lines 20 and 22 which pass through the shell 12, the present invention makes hermetic compressor unit 10 the equivalent of a reversible compressor and has the same external structural requirements with the structure for actuating solenoid 32 corresponding to the structure for reversing the motor direction of a reversible compressor. Further, internally, the hermetic compressor unit 10 is a conventional unit with valves 30 and 40 and their connections added which makes the present invention suitable for converting single direction compressors for heat pump applications.

Where the present invention is to be used in a high-side compressor, a couple of modifications are necessary. The corresponding structure is numbered 100 higher in FIGS. 5 and 6 than in FIGS. 3 and 4. The changes in the structure of a high-side compressor are that shell 112 now defines a discharge plenum 115, that line 119 is the suction line of the compressor 118, that the direction of the bias of spring 156 is reversed as are the corresponding steps **149*a* and 152*a* of bore 149 and that passage 139 in valve member 138 of solenoid valve 130 causes the pressurized refrigerant gases in plenum 115 to be supplied to bore 149 to act on land 144 rather than to exhaust the refrigerant gases from bore 149 into plenum 115. The basic difference in the high-side device is that plenum 115 is at discharge pressure and that spool valve 140 controls the supply of suction gas to the compressor 118**.

Figure 5:
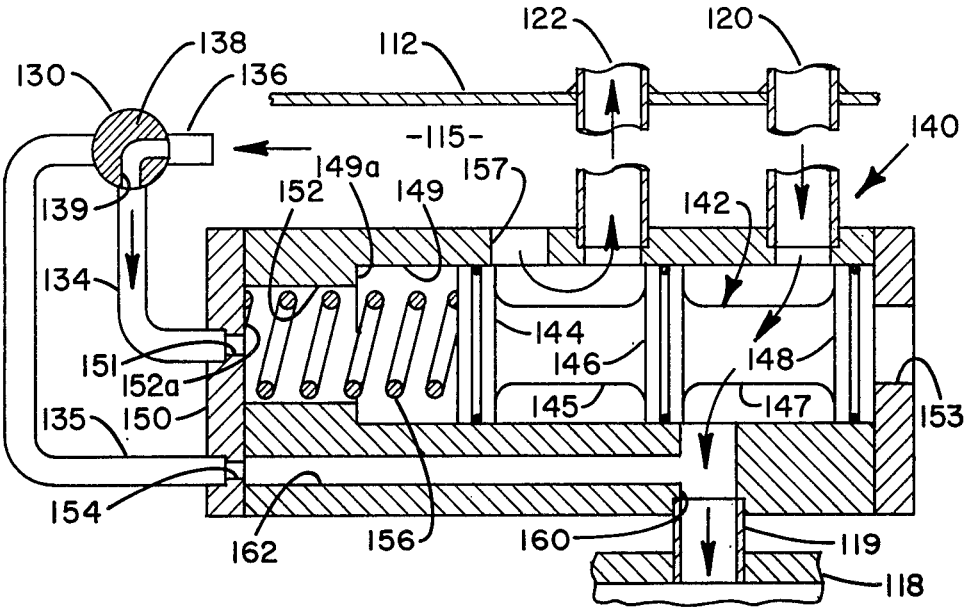
FIG. 5 is a sectional view showing a first position of a modified spool valve in a high-side compressor.

In operation, assuming that FIG. 5 represents the position of valve member 138 of solenoid valve 130 when the solenoid is not actuated, the motor drives compressor 118 such that gaseous refrigerant is drawn into the compressor 118 from line 120 via the annular space defined by groove 147 of spool 142, passage 160 and suction line 119. Compressor 118 compresses the refrigerant and the compressed refrigerant is discharged from compressor 118 into the discharge plenum 115 defined by shell 112. The compressed refrigerant passes from plenum 115 via bore 157, the annular space defined by groove 145 and line 122. Spool 142 stays in the FIG. 5 position because discharge pressure acts on the land 144 via line 136, passage 139 in valve member 138, line 134, bore 151 and bore 149 and acts on land 148 via bore 153 so that discharge pressure cancels out. The bias of compression spring 156, therefore, keeps spool 142 in the FIG. 5 position since it is the only net force acting on spool 142.

Figure 6:
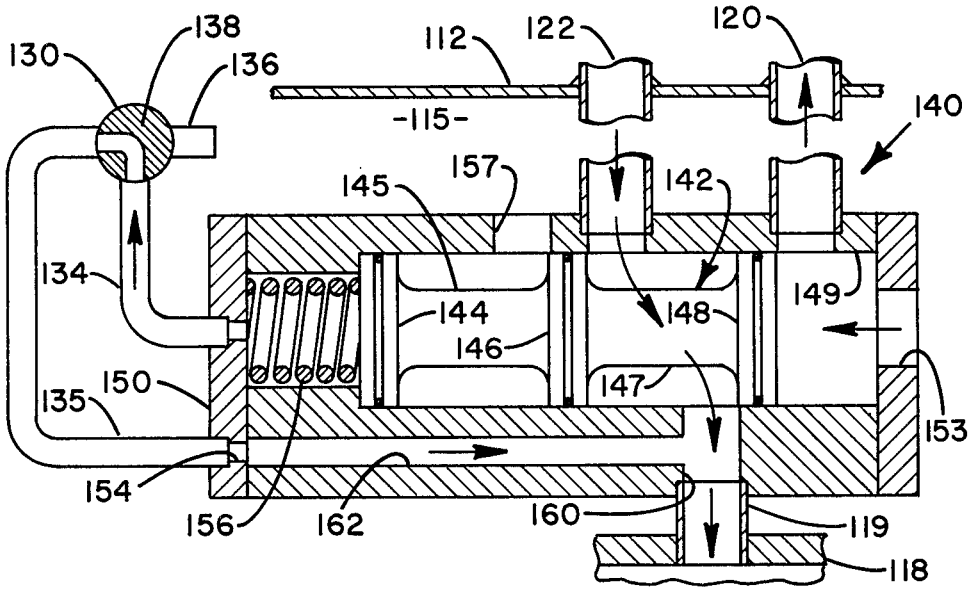
FIG. 6 is a sectional view showing a second position of the modified spool valve in a high-side compressor.

If the solenoid of solenoid valve 130 is actuated, valve member 138 is rotated to the FIG. 6 position whereby fluid communication between discharge plenum 115 and bore 149 via line 136, passage 139 and line 134 is cut off. Additionally, the bore 149 at the end of spool 142 at which land 144 is located is placed in fluid comnunication with suction line 119 via line 134 passage 139, line 135, bore 154, bore 162 and passage 160. As land 148 is still subject to compressor discharge pressure via bore 153, compressor discharge pressure acting on land 148 shifts spool 142 to the FIG. 6 position against the opposing force of spring 156 and the suction pressure acting on land 144. Refrigerant is drawn into compressor 118, via line 122, the annular space defined by groove 147 of spool 142, passage 160 and suction line 119. Compressed refrigerant discharged by compressor 118 into discharge plenum 115 passes via bore 153 and bore 149 into line 120 which delivers the compressed refrigerant to the coil (not illustrated) acting as a condenser. If the solenoid of solenoid valve 130 is deactivated, it will cause valve member 138 to return to the FIG. 5 position whereby discharge plenum pressure acts on both ends of spool 142 and cancels and spring 156 shifts spool 142 to the right, as illustrated in FIG. 5.

Although a preferred embodiment of the present invention has been illustrated and described, other changes will occur to those skilled in the art. For example, either the FIG. 3 or the FIG. 4 position of valve member 38 can correspond to the actuated/unactuated position of solenoid 32. It is, therefore, intended that the present invention is to be limited only by the scope of the appended claims.

What is claimed is:

1. A reversible hermetic compressor unit comprising:
shell means;
compressor means within said shell means;
motor means within said shell means for driving said compressor means in only one direction;
valve means within said shell means;
a first fluid line extending through said shell means and connected to said valve means;
a second fluid line extending through said shell means and connected to said valve means;
a compressor discharge line extending from said compressor means to said valve means;
means for reversibly moving said valve means between a first position in which said compressor discharge line is fluidly connected to said first fluid line and a second position in which said compressor discharge line is fluidly connected to said second fluid line whereby the output of said compressor means can be selectively directed through either one of said first and second fluid lines; and
said valve means further including means for connecting said second fluid line to the interior of said shell means when said valve means is in said first position and for connecting said first fluid line to the interior of said shell means when said valve means is in said second position.

2. The reversible hermetic compressor unit of claim 1 wherein said means for reversibly moving said valve means includes a solenoid valve.

3. A reversible hermetic compressor unit comprising:
shell means;
compressor means within said shell means;
motor means within said shell means for driving said compressor means in only one direction;
spool valve means within said shell means;
a first fluid line extending through said shell means and connected to said valve means;
a second fluid line extending through said shell means and connected to said valve means;
a compressor discharge line extending from said compressor means to said valve means; and
means for selectively connecting said compressor discharge line to one end of said valve means to cause said valve means to move against a spring bias for reversibly moving said valve means between a first position in which said compressor discharge line is fluidly connected to said first fluid line and a second position in which said compressor discharge line is fluidly connected to said second fluid line whereby the output of said compressor means can be selectively directed through either one of said first and second fluid lines.

4. The reversible hermetic compressor unit of claim 3 wherein said means for selectively connecting said compressor discharge line to one end of said spool valve includes passage means in said valve means.

5. A reversible hermetic compressor unit comprising:
shell means;
compressor means within said shell means;
motor means within said shell means for driving said compressor means in only one direction;
valve means within said shell means;
a first fluid line extending through said shell means and connected to said valve means;
a second fluid line extending through said shell means and connected to said valve means;
a compressor suction line extending from said compressor means to said valve means; and
means for reversibly moving said valve means between a first position in which said compressor suction line is fluidly connected to said first fluid line and a second position in which said compressor suction line is fluidly connected to said second fluid line whereby the input of said compressor means can be selectively supplied through either one of said first and second fluid lines.

6. In the reversible hermetic compressor unit of claim 5, said valve means further including means for connecting the interior of said shell means with said second fluid line when said valve means is in said first position and for connecting the interior of said shell means with said first fluid line when said valve means is in said second position.

7. The reversible hermetic compressor unit of claim 5 wherein said means for reversibly moving said valve means includes a solenoid valve.

8. The reversible hermetic compressor unit of claim 5 wherein said valve means is a spool valve.

9. The reversible hermetic compressor unit of claim 8 wherein said means for reversibly moving said valve means includes means for selectively connecting said compressor suction line to one end of said spool valve to cause said spool valve to move against a spring bias.

10. The reversible hermetic compressor unit of claim 9 wherein said means for selectively connecting said compressor suction line to one end of said spool valve includes passage means in said valve means.

* * * * *